US005360027A

United States Patent [19]

Harman

[11] Patent Number: 5,360,027

[45] Date of Patent: Nov. 1, 1994

[54] PNEUMATIC CLEANING SYSTEM

[75] Inventor: Jonathan W. Harman, Ponte Vedra, Fla.

[73] Assignee: Environmental Solvents Corporation, Jacksonville, Fla.

[21] Appl. No.: 132,057

[22] Filed: Oct. 5, 1993

[51] Int. Cl.[5] ..... B08B 3/10

[52] U.S. Cl. ..... 134/102.3; 34/235; 134/61; 134/111; 202/170

[58] Field of Search ..... 134/61, 102.1, 102.3, 134/105, 108, 111; 202/170; 34/125, 232, 235

[56] References Cited

U.S. PATENT DOCUMENTS

| | | | |
|---|---|---|---|
| 1,198,990 | 9/1916 | Bashlin | 202/170 |
| 4,558,524 | 12/1985 | Peck et al. | 134/105 X |
| 4,613,412 | 9/1986 | MacDermid | 202/202 X |
| 4,929,312 | 5/1990 | Westcott | 202/170 X |
| 4,983,223 | 1/1991 | Gessner | 134/105 X |
| 5,143,103 | 9/1992 | Basso et al. | 134/105 X |
| 5,156,173 | 10/1992 | Keyser et al. | 134/108 X |

*Primary Examiner*—Philip R. Coe
*Attorney, Agent, or Firm*—Cesari and McKenna

[57] ABSTRACT

A pneumatic cleaning and degreasing system that draws power from a single source of compressed air and provides agitation, active draining of solvent, drying, odor-control and optional recirculation features. The preferred configuration of the invention provides for the use of two solvents, each in a separate chamber. Agitation, drainage and, if desired, solvent recirculation are accomplished by means of a pair of pneumatic pumps. An air venturi withdraws solvent vapors from the plenum into which the solvent chambers open, thereby creating a vapor gradient that facilitates rapid drying. When the device is inactive, a smaller flow through the air venturi removes solvent fumes to reduce or eliminate perceptible odors.

5 Claims, 1 Drawing Sheet

PNEUMATIC CLEANING SYSTEM

BACKGROUND OF THE INVENTION

A. Field of the Invention

Figure 1:
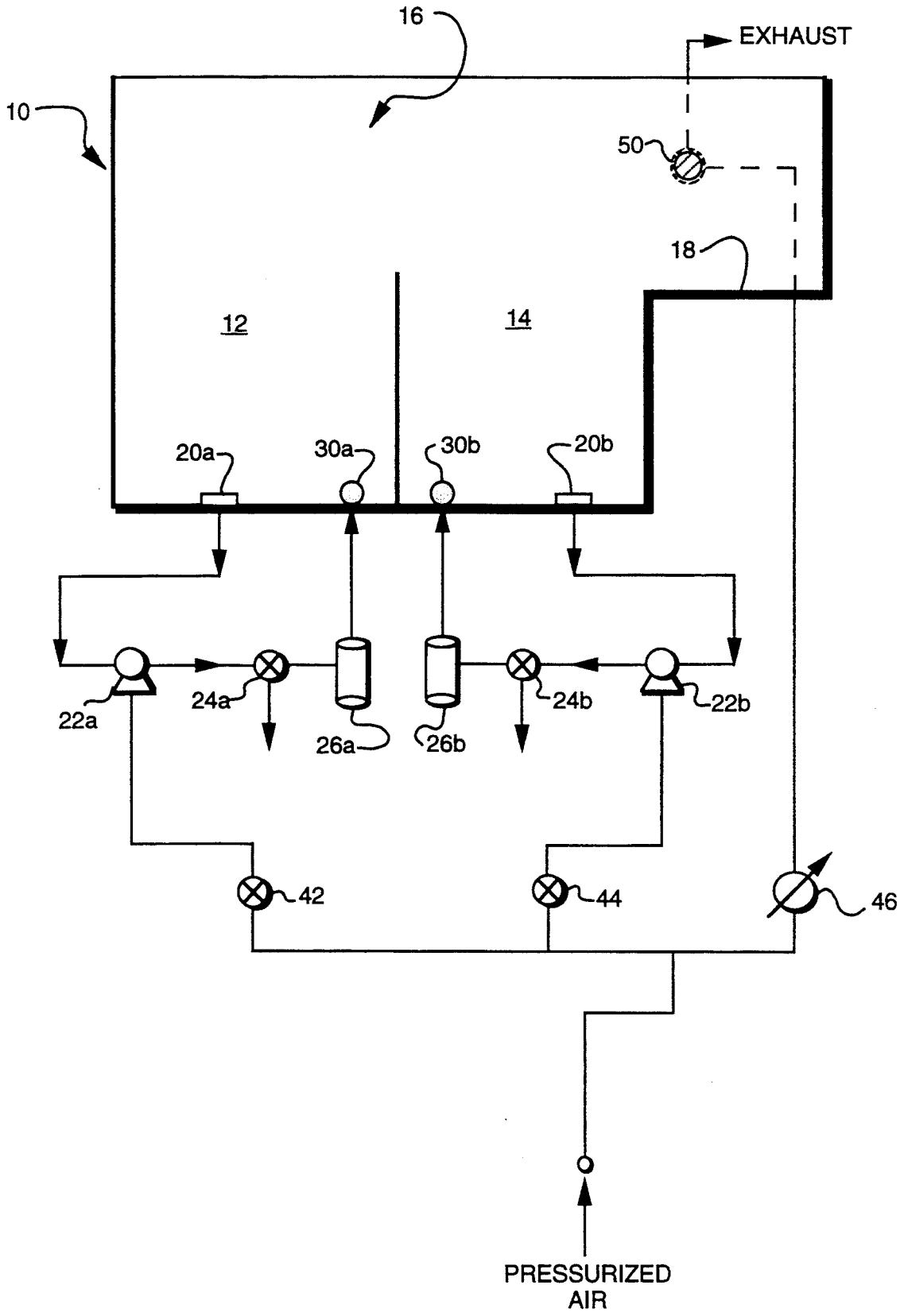

The present invention relates to cleaning and degreasing apparatus, and in particular to a system, driven solely by compressed air or other inert gas, for cleaning, rinsing, and drying soiled articles.

B. Description of the Related Art

A wide variety of manufactured items acquire layers of grease or other contaminants during fabrication, storage or use. Such items include printed circuit boards, electronic components, machined metal parts and assemblies, and components fabricated from plastic, glass and ceramic materials. In order to maintain the usefulness of these items, they must be periodically (or at least initially) rendered free of contaminants.

Conventional degreaser designs provide for subjection of the soiled article to the action of one or more solvents, followed by removal of residual solvent by drying. For reasons of economy most systems avoid the use of water, which must typically be provided in deionized form and disposed of in an environmentally responsible fashion. In older commercial systems, a single organic solvent having a high vapor pressure could be employed to clean, rinse and dry a soiled article; the solvent's volatility ensured rapid and complete solvent removal. However, recent statutory and regulatory environmental restrictions have severely limited the availability of high-vapor-pressure cleaning liquids that exhibit adequate solvency power.

Therefore, current degreasing techniques typically involve sequential application of multiple solvents. For example, a low-vapor-pressure, high-boiling-point solvent may be employed to clean soiled articles, which are then immersed in a high-vapor-pressure "rinsing" solvent; the latter component, while deficient in solvency strength, readily removes the cleaning solvent and is itself easily evaporated. Multiple-solvent arrangements permit each solvent in the sequence to be utilized to maximum advantage.

Degreasing devices, particularly those adapted for multiple solvents, are often rather complex. Even units that omit means for heating the solvents typically require the interaction of agitation components, drying assemblies, and drainage and exhaust systems for effective operation. Such devices ordinarily depend on electric power.

Unfortunately, electrical components can present unacceptable safety hazards in an environment that often favors use of solvents that may be combustible or flammable. Absent elaborate (and expensive) isolation designs, electrically powered degreasers generally cannot be used with such solvents. Moreover, the danger of combustion is increased by the need for conventional degreasers to remain open to the atmosphere, permitting the entry of oxygen into the solvent-vapor zone and thereby increasing the susceptibility of the vapor to ignition.

DESCRIPTION OF THE INVENTION

A. SUMMARY OF THE INVENTION

The present invention, whose operation is fully pneumatic, offers an alternative to traditional, electrically powered degreasing designs and facilitates safe use of combustible and/or flammable solvents. Drawing power from a single source of compressed air, a resource commonly found in manufacturing and other facilities that require degreasing equipment, the present invention provides agitation, active draining of solvent, recirculation (if desired), drying and odor-control features.

The preferred configuration of the invention provides for the use of two solvents, each in a separate chamber. Agitation, drainage and, if desired, solvent recirculation are accomplished by means of a pair of pneumatic pumps. An air venturi withdraws solvent vapors from the plenum into which the solvent chambers open, thereby creating a vapor gradient and airflow that together facilitate rapid drying. When the device is inactive, a smaller flow through the air venturi removes solvent fumes to reduce or eliminate perceptible odors.

B. BRIEF DESCRIPTION OF THE DRAWING

The foregoing discussion will be understood more readily from the following detailed description of the invention, when taken in conjunction with the single FIGURE of the drawing, which schematically illustrates the features of the present invention.

C. DETAILED DESCRIPTION OF THE PREFERRED EMBODIMENTS

As shown in FIG. 1, the present invention includes a housing 10, in which are formed first and second cleaning chambers 12, 14 that open into a common plenum 16. Each of these chambers contains a different cleaning fluid. Preferably chamber 12 contains the primary cleaning (or "wash") solvent, which has high solvency power and may be combustible or flammable, and chamber 14 contains a rinse solvent for removal of the wash solvent. The rinse solvent is miscible with the wash solvent and is easily dried. Suitable wash solvents include terpene solvents, non-halogenated hydrocarbons having a range of flash points, and blends of dibasic esters. Suitable rinse solvents have relatively high vapor pressures to facilitate rapid and complete drying, and include, for example, mineral spirits and light alcohols such as ethanol or isopropanol.

Housing 10 preferably also includes a drying shelf 18 to support an article after it has emerged from the rinse solvent. This represents the simplest means for retaining the article during the drying stage; other arrangements may be also be employed advantageously, depending on the nature of the articles to be cleaned. For example, components having complex surface features that tend to retain pools of solvent may be suspended in plenum 16 from a hook or within a mesh.

Each chamber includes a drain 20*a*, 20*b*, connected to an active withdrawal assembly and, preferably, also to a recirculation system. Each withdrawal assembly consists of an air-driven pump 22*a*, 22*b*, which feeds withdrawn fluid to a valve 24*a*, 24*b* that leads to a waste receptacle (not shown). In the preferred embodiment, however, each valve 24*a*, 24*b* is bidirectional, allowing fluid to be diverted to a particulate filter 26*a*, 26*b* and thereafter into the respective chamber through an agitation means 30*a*, 30*b*. Agitation means 30*a* and 30*b* impart turbulence as they deliver fluid into the chamber. Suitable agitation means include, for example, liquid venturies and spray nozzles.

It is not necessary that both chambers be provided with the same draining and recirculation arrangement. Depending on the solvents employed it may, for example, be preferable to eliminate the agitation, recirculation, and even the active draining assembly from one of the chambers but not the other.

All of the active components of the present invention, including pumps 22*a* and 22*b*, are powered by a source of pressurized air (or other inert gas). That source may already exist within the user's environment, or may be provided by a dedicated compressor. In the latter case, the compressor can be physically located remotely enough from the present apparatus to ensure its effective isolation from combustible solvents.

As depicted in FIG. 1, pressurized air is directed to a series of three control valves 42, 44 and 46. Valves 42 and 44 control the flows of air that power pumps 22*a* and 22*b*, respectively, and need not be graduated; indeed, in a preferred embodiment, these valves are simply pneumatic switches that are either fully open or fully closed.

Valve 46 is preferably a two-position pneumatic switch that allows the user to select either of two flow rates (although, obviously, equivalent performance can be obtained less conveniently by use of a continuously variable valve with the two proper settings marked on a control plate). Valve 46 controls the flow of air to an air venturi 50, whose inlet is flush with one wall of housing 10, and is preferably located within plenum 16 proximate to drying shelf 18. The outlet of air venturi 50 is vented to an exhaust manifold or a scrubber.

Air venturi 50 preferably exploits the coanda effect, utilizing compressed air as a primary stream to draw relatively large volumes of air through its inlet, expelling the combined flow of primary and surrounding air at relatively high velocity. This component performs two important functions. With valve 46 set to its lower flow rate, representing an idle condition, the draw rate of air venturi 50 is just large enough to withdraw odiferous vapors from plenum 16. For example, in a typical configuration, which utilizes an air amplifier manufactured by Exair Corporation, Cincinnati, Ohio to serve as air venturi 50, an input pressure (regulated by valve 46) of 10 lb/in$^2$ (psi) produces an output flow of 100–150 ft$^3$/min (cfm); that flow rate largely, if not completely, prevents solvent fumes within plenum 16 from emerging and entering the atmosphere during periods of device inactivity.

With valve 46 set to its higher flow rate, venturi 50 performs an active drying function by maintaining a low solvent vapor concentration within and creating an air flow across plenum 16. More specifically, the vapor concentration follows a gradient from the two chambers to the inlet of air venturi 50. After exposure of the article to the rinsing solvent, which preferably exhibits a relatively high vapor pressure, brief suspension of the article near air venturi 50 (i.e., in the region of relatively low vapor concentration) will serve to evaporate the residual solvent. In the configuration mentioned above, an input pressure of 70 psi to air venturi 50 produces an output flow of 500–600 cfm, which is adequate for most drying applications.

It should be understood that although the recirculation loops and valves appear in FIG. 1 separate from housing 10, this is solely for ease of presentation. Most of these components can conveniently reside in cavities behind or below the chambers and/or shelf 18; valves 24*a*, 24*b*, 42, 44 and 46 can be mounted behind a faceplate that serves as a control panel.

It will therefore be seen that the foregoing represents a highly advantageous approach to solvent-based cleaning without the need for electrical components. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed. For example, the number of chambers can be expanded to accommodate more than two solvents; degreasers with three or four chambers are well-known to the industry.

What is claimed is:

1. A pneumatic driven cleaning apparatus comprising:

a. a housing comprising at least one chamber recessed therein for containing a solvent, the at least one chamber opening into a plenum;

b. an air venturi in communication with the plenum and having an output port directed away from the plenum;

c. venting means associated with the output port of the air venturi for conducting vapor withdrawn by the venturi away from the plenum, thereby creating a vapor gradient within and an air flow across the plenum;

d. means for supporting, within the plenum and in a zone of the vapor gradient of low vapor concentration, an article to be cleaned;

e. means for coupling the air venturi to a source of air under pressure;

f. pneumatic agitation means associated with at least one chamber;

g. pneumatic draining means associated with at least one chamber for actively withdrawing liquid contained therein; and h. a common air line originating with the source of air under pressure, operatively connected to the draining means, the agitation means and the air venturi, and terminating at the air venturi.

2. The apparatus of claim 1 wherein the draining means is a drain port coupled to the input port of a pneumatic pump having input and output ports.

3. The apparatus of claim 2 further comprising recirculation means connected to the draining means, the recirculation means comprising:

a. an inlet means coupled to at least one chamber;

b. a filter; and c. a selectably activatable fluid-transport line connecting the output port of the pump with the inlet means and passing through the filter.

4. A pneumatic driven cleaning apparatus comprising:

a. a housing comprising at least one chamber recessed therein for containing a solvent, the at least one chamber opening into a plenum;

b. an air venturi in communication with the plenum and having an output port directed away from the plenum;

c. venting means associated with the output port of the air venturi for conducting vapor withdrawn by the venturi away from the plenum, thereby creating a vapor gradient within and an air flow across the plenum;

d. means for supporting, within the plenum and in a zone of the vapor gradient of low vapor concentration, an article to be cleaned;

e. means for coupling the air venturi to a source of air under pressure; and f. means for limiting the air flow to the air venturi, said means having a first setting that allows sufficient flow through the air venturi to evacuate odors from the plenum, and a second setting that allows a greater flow through the air venturi to facilitate drying of an article disposed in the article-supporting means.

5. The apparatus of claim 4 wherein the air venturi is disposed within the housing in a position proximate to the article-supporting means.

* * * * *